US012606755B2

(12) United States Patent
Jeon et al.

(10) Patent No.: US 12,606,755 B2
(45) Date of Patent: Apr. 21, 2026

(54) METHOD OF PRODUCING LUBE BASE OIL AND LUBE BASE OIL PRODUCED THEREBY

(71) Applicants: SK INNOVATION CO., LTD., Seoul (KR); SK ENMOVE CO., LTD., Seoul (KR)

(72) Inventors: Young Wook Jeon, Daejeon (KR); Jun Soo Park, Daejeon (KR); Kyung Seok Noh, Daejeon (KR)

(73) Assignees: SK INNOVATION CO., LTD., Seoul (KR); SK ENMOVE CO., LTD., Seoul (KR)

( * ) Notice: Subject to any disclaimer, the term of this patent is extended or adjusted under 35 U.S.C. 154(b) by 145 days.

(21) Appl. No.: 18/614,747

(22) Filed: Mar. 25, 2024

(65) Prior Publication Data

US 2025/0026997 A1 Jan. 23, 2025

(30) Foreign Application Priority Data

Jul. 18, 2023 (KR) ..... 10-2023-0093262

(51) Int. Cl.
*C10G 67/04* (2006.01)
*C10M 175/00* (2006.01)
(Continued)

(52) U.S. Cl.
CPC ..... *C10G 67/04* (2013.01); *C10M 175/0041* (2013.01); *C10G 2300/1007* (2013.01);
(Continued)

(58) Field of Classification Search
CPC ..... C10G 67/04; C10G 2300/1007; C10G 2300/302; C10G 2300/304;
(Continued)

(56) References Cited

U.S. PATENT DOCUMENTS 4,512,878 A * 4/1985 Reid ..... C10M 175/02 208/89
10,174,264 B2 1/2019 Morel et al.
11,034,895 B1 * 6/2021 Oza ..... C10G 45/60

FOREIGN PATENT DOCUMENTS

CA 3045734 A1 * 6/2018 ..... B01J 29/703
EP 4137553 A1 2/2023
(Continued)

OTHER PUBLICATIONS

Extended European Search Report for European Patent Application No. 24163928.5 issued by the European Patent Office on Aug. 13, 2024.

*Primary Examiner* — Prem C Singh
*Assistant Examiner* — Juan C Valencia
(74) *Attorney, Agent, or Firm* — IP & T GROUP LLP

(57) ABSTRACT

A method of producing a lube base oil mixture includes providing a waste lubricant-derived refined oil fraction derived from a waste lubricant containing a lube base oil of API Group I or II. The waste lubricant-derived refined oil fraction contains an ionic refined oil, a first regenerated base oil, or a combination thereof, dewaxing the waste lubricant-derived refined oil fraction to produce a second regenerated base oil, and blending the second regenerated base oil with a separate lube base oil to produce a lube base oil mixture of Group III or higher. The method has an economical advantage because low-quality waste lubricant is used as a feedstock for the production of higher quality lube base oils. In addition, the method is advantageous in an environmentally friendly aspect because waste lubricant is reused rather than being disposed of.

16 Claims, 1 Drawing Sheet

(51) Int. Cl.

| | |
|---|---|
| ***C10N 30/00*** | (2006.01) |
| ***C10N 30/02*** | (2006.01) |
| ***C10N 70/00*** | (2006.01) |

(52) U.S. Cl.
CPC . *C10G 2300/302* (2013.01); *C10G 2300/304* (2013.01); *C10G 2400/10* (2013.01); *C10M 2203/1006* (2013.01); *C10N 2030/02* (2013.01); *C10N 2030/43* (2020.05); *C10N 2070/00* (2013.01)

(58) Field of Classification Search
CPC ..... C10G 2400/10; C10G 2300/1062; C10G 45/58; C10G 65/043; C10G 67/02; C10G 49/02; C10G 53/02; C10G 65/02; C10G 67/00; C10G 73/02; C10M 175/0041; C10M 2203/1006; C10M 175/005; C10M 175/0058; C10M 175/02; C10M 175/0033; C10M 177/00; C10M 171/02; C10N 2030/02; C10N 2030/43; C10N 2070/00
See application file for complete search history.

(56) References Cited

FOREIGN PATENT DOCUMENTS

| | | | |
|---|---|---|---|
| KR | 10-2021-0002682 | A | 1/2021 |
| KR | 10-2442618 | B1 | 9/2022 |
| WO | 2019/014681 | A2 | 1/2019 |
| WO | 2019213157 | A1 | 11/2019 |

* cited by examiner

METHOD OF PRODUCING LUBE BASE OIL AND LUBE BASE OIL PRODUCED THEREBY

CROSS REFERENCE TO RELATED APPLICATION

The present application claims priority to Korean Patent Application No. 10-2023-0093262, filed Jul. 18, 2023, the entire contents of which are incorporated herein for all purposes by this reference.

BACKGROUND OF THE DISCLOSURE

1. Field of the Disclosure

Embodiments of the present disclosure relate to a method of producing a lube base oil and a lube base oil produced thereby.

2. Description of the Related Art

Waste lubricant undergoes a series of refining processes to obtain refined oil. The entire amount of the refined oil is used as fuel oil in Korea. However, in overseas countries, a portion of the refined oil is used as fuel oil, and the remainder is used as low-grade regenerated base oil.

On the other hand, good lube base oils have a high viscosity index, high stability (resistant to oxidation, heat, UV, etc.), and low volatility. The American Petroleum Institute (API) classifies lube base oils according to their quality as shown in Table 1 below.

TABLE 1

| Group | Content of sulfur (ppm) | | Saturation (%) | Viscosity index (VI) |
|---|---|---|---|---|
| I | >300 | and/or | <90 | 80-120 |
| II | ≤300 | and | ≥90 | 80-120 |
| III | ≤300 | and | ≥90 | >120 |
| IV | All Polyalphaolefins (PAOs) | | | |
| V | All stocks not in Groups I-IV | | | |

In the above classification, the quality of lube base oils increases from Group I to V, of which Group III lube base oils are generally produced by advanced hydrocracking reactions. Typically, unconverted oil, which is a heavy oil fraction that is not converted to fuel oil during a fuel oil hydrocracking process, is used as a feedstock for the production of Group III and higher lube base oils.

SUMMARY OF THE DISCLOSURE

Embodiments of the present disclosure relate to a method of producing a lube base oil and a lube base oil produced thereby.

According to a first embodiment of the present disclosure, there is provided a method of producing a lube base oil mixture, the method including: providing a waste lubricant-derived refined oil fraction, in which the waste lubricant-derived refined oil fraction is derived from a waste lubricant containing a lube base oil of API Group I or II, and the waste lubricant-derived refined oil fraction contains an ionic refined oil, a first regenerated base oil, or a combination thereof; dewaxing the waste lubricant-derived refined oil fraction to produce a second regenerated base oil; and blending the second regenerated base oil with a separate lube base oil to produce a lube base oil mixture of Group III or higher.

According to an embodiment, the refined oil fraction derived from the waste lubricant may have a sulfur content in a range of from 200 ppm to 3000 ppm, a nitrogen content in a range of 100 ppm and 1200 ppm, and a kinematic viscosity at 100° C. in a range of 4 to 11 cSt.

According to an embodiment, the dewaxing may involve hydrotreating, hydro-dewaxing, and hydrofinishing the waste lubricant-derived refined oil fraction.

According to an embodiment, the hydro-dewaxing may be carried out in the presence of a catalyst including at least one of an EU-2 zeolite carrier, an alumina carrier, and a silica-alumina carrier, and may be carried out at a temperature in a range of 300° C. to 350° C. at a pressure in a range of 60 kg/cm$^2$ to 150 kg/cm$^2$.

According to an embodiment, the catalyst may include Co, Ni, Pt, Pd, Mo, W, or any combination thereof as a metal active component.

According to an embodiment, the separate lube base oil may have a kinematic viscosity (at 100° C.) of 6 to 7 cSt, a viscosity index of 120 or more, a pour point of −10° C. or less, and a cold crank simulator (CCS) viscosity (at −30° C.) of 5400 cP or less.

According to an embodiment, the amount of the second regenerated base oil blended in the blending operation may be 1 to 30% by volume of the group III or higher lube base oil mixture.

According to a second embodiment of the present disclosure, there is provided a lube base oil mixture including the above-described second regenerated base oil.

According to an embodiment, the lube base oil mixture including the second regenerated base oil may have a viscosity index of 120 or more and a saturation degree of 90% or more.

According to a second embodiment of the present disclosure, there is provided a method of producing a lube base oil mixture, the method comprising: subjecting an ionic refined oil to a vacuum distillation to obtain a vacuum ionic refined oil; mixing the vacuum ionic refined oil with a first regenerated base oil to make a waste lubricant-derived refined oil fraction; dewaxing the waste lubricant-derived refined oil fraction to produce a second regenerated base oil; and blending the second regenerated base oil with a separate lube base oil to produce a lube base oil mixture of Group III or higher.

According to an embodiment, the vacuum refined oil contained a heavy oil with a boiling point of 400° C. or more and 550° C. or less.

According to an embodiment, prior to the vacuum distillation the ionic refined oil is produced by subjecting a first waste lubricant having a sulfur content of about 2000 ppm, a nitrogen content of about 1500 ppm, and a chlorine content of about 1500 ppm to centrifugation followed by atmospheric distillation.

According to an embodiment, the atmospheric distillation was performed at a temperature of 50° C. to 350° C. at atmospheric pressure, and wherein the vacuum distillation was performed at a temperature of 100° C. to 350° C. and a pressure of 10 torr.

According to an embodiment, the first regenerated base oil is produced by subjecting a second waste lubricant having a same impurity content as the first waste lubricant described above to hydrotreating in a temperature condition of about 300° C., a pressure condition of about 60 to 150 kg/cm$^2$, a liquid hourly space velocity (LHSV) condition of about 3.0 $hr^{-1}$, and a volume ratio of hydrogen to oil derived from the waste lubricant of about 1000.

According to an embodiment, the vacuum ionic refined oil and the first regenerated base oil were mixed in a volume ratio of 1:1.

According to an embodiment, the hydro-dewaxing is performed at a temperature of about 350° C. and a pressure of about 150 $kg/cm^2$, in the presence of a hydrogenation catalyst containing EU-2 zeolite as a carrier and Ni as a metal active component, wherein the hydrofinishing is carried out in the presence of the same hydrogenation catalyst as used in the hydro-dewaxing, at a temperature of about 230° C. and at a pressure of about 60 to 150 $kg/cm^2$.

Embodiments of the present disclosure have an economical advantage in that low-quality waste lubricant can be used as a feedstock for the manufacturing process of higher quality lube base oil. In addition, the embodiments of the present disclosure are advantageous in an environmentally friendly aspect because waste lubricant is reused rather than disposed of.

DETAILED DESCRIPTION

The above and other objectives, features, and advantages of the embodiments of the present disclosure will be more clearly understood from the following detailed description taken in conjunction with the accompanying drawings, but the embodiments of the present disclosure are not limited thereto. In describing the embodiments, when the detailed description of the relevant known technology is determined to unnecessarily obscure the gist of the present disclosure, the detailed description may be omitted.

Hereinafter, an embodiment of the present disclosure will be described in detail with reference to the accompanying drawings.

According to a first embodiment, there is provided a method of producing a lube base oil mixture, the method including: providing a waste lubricant-derived refined oil fraction, in which the waste lubricant-derived refined oil fraction is derived from a waste lubricant containing a lube base oil of API Group I or II, and the waste lubricant-derived refined oil fraction contains an ionic refined oil, a first regenerated base oil, or a combination thereof; dewaxing the waste lubricant-derived refined oil fraction to produce a second regenerated base oil; and blending the second regenerated base oil with a separate lube base oil to produce a lube base oil mixture of Group III or higher. The method of producing the lube base oil mixture is schematically illustrated in FIG. 1.

Figure 1:
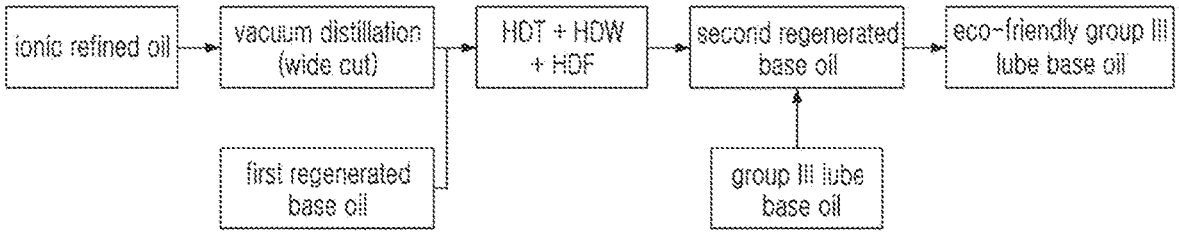
FIGS. 1 and 2 are schematic diagrams of a process according to an embodiment of the present disclosure.

Referring to FIG. 1, an ionic refined oil 10 was subjected to a vacuum distillation 20 and then blended with a first regenerated base oil 30. The vacuum ionic refined oil obtained through vacuum distillation performed under the process conditions described below contained a heavy oil fraction with a boiling point of 400° C. or more and 550° C. or less.

The vacuum ionic refined oil and the first regenerated base oil were mixed, for example in a volume ratio of 1:1 to obtain a waste lubricant-derived refined oil fraction, followed by hydrotreating ("HDT"), hydro-dewaxing ("HDW"), and hydrofinishing ("HDF") as denoted by numeral 40 in FIG. 1.

The obtained second regenerated base oil 50 was then blended with a separate lube base oil 60 to obtain a lube base oil mixture. Here, the amount of the second regenerated used in the blending may be varied.

The lube base oil mixture 70 prepared by the above production method exhibits an excellent balance of specific gravity, kinematic viscosity, viscosity index (VI), kinematic viscosity, a sulfur content, a nitrogen content, and contained almost no impurities except for unavoidable trace amounts of impurities. It was found that the lube base oil mixture fulfills the criteria of Group III lube base oils shown in Table 1 above.

The waste lubricant-derived refined oil fraction may be derived from a waste lubricant containing a lube base oil of Group I or II according to the API lube base oil classification, and more specifically is derived from a waste lubricant containing a lube base oil of Group I or II. Specifically, a lube base oil of Group I or II has a sulfur content of 300 ppm or more, a saturation degree of less than 90%, a viscosity index of 120 or less, or a combination thereof. Typically, lubricants contain various additives in addition to a lube base oil. The additives contain large amounts of impurities that make the additives unsuitable for use in lubricants, and refined oil fractions derived from waste lubricants may also contain large amounts of impurities. For example, waste lubricants containing the lube base oil of Group I or II may contain 1000 to 3000 ppm of sulfur, 500 to 2000 ppm of nitrogen, 100 to 2000 ppm of chlorine, and other metallic impurities that may be introduced during lubrication.

In an embodiment, the operation of providing the waste lubricant-derived refined oil fraction may include centrifugation, atmospheric distillation, or vacuum distillation of waste lubricant, or a combination thereof. The operation corresponds to an operation of reducing the content of sulfur, nitrogen, chlorine and metal impurities present in the oil derived from waste lubricant. As used herein, the term "waste lubricant-derived refined oil fraction" refers to oil obtained after the introduction of an oil fraction derived waste lubricant into the refining operation, and the waste lubricant-derived refined oil fraction has a reduced impurity content compared to the used waste lubricant.

The operation of providing the waste lubricant-derived refined oil fraction may include centrifugation, vacuum distillation, and atmospheric distillation of waste lubricant containing a lube base oil of Group I or II. In an embodiment, the centrifugation, atmospheric distillation, and vacuum distillation may be performed sequentially in this order.

The centrifugation separates and remove impurities present in the waste lubricant and may be performed at a rotation speed of about 100 rpm to 3000 rpm. Instead of the centrifugal separation, natural sedimentation may be used to remove the impurities. However, the centrifugal separation is advantageous in terms of separation speed and performance. Furthermore, the centrifugation operation may involve the introduction of a flocculant. In this case, the impurities agglomerated by the introduction of the flocculant are separated and removed by rotation. The flocculant may be any flocculant that enables the agglomeration of impurities, but as a non-limiting example, ammonium phosphate may be used as the flocculant. In an embodiment, the centrifugation operation is performed at a temperature in a range of 80° C. to 120° C. The separation of the agglomerates can be facilitated within the temperature range.

In an embodiment, after the high-density solid impurities that are not miscible with the waste lubricant are primarily removed by the centrifugal separation, the waste lubricant undergoes atmospheric distillation performed under atmospheric pressure. The atmospheric distillation is performed at a temperature in a range of about 50° C. to 350° C. As the atmospheric distillation temperature increases, fractions in the waste lubricant are distilled and fractionated in order of lower boiling points. Among the fractions fractionated through the atmospheric distillation operation, a fraction having a boiling point of about 150° C. or higher is collected to produce the refined oil. The oil derived from waste lubricant through centrifugation and atmospheric distillation may be referred to as "ionic refined oil".

In an embodiment, the oil fraction collected in the atmospheric distillation operation undergoes a vacuum distillation process. The vacuum distillation is performed for further fractionation of the oil fraction obtained in the atmospheric distillation operation. When the distillation temperature is increased for the fractionation of the oil fraction under atmospheric pressure, oil fraction cracking may occur. For this reason, this operation is performed in reduced pressure and mild temperature conditions. The vacuum distillation may be performed at a pressure of 10 torr or less and a temperature of 150° C. to 350° C. During the vacuum distillation operation, a fraction having a boiling point of 300° C. to 550° C. is collected, and the collected fraction is referred to as "vacuum ionic refined oil". The vacuum ionic refined oil has a specific gravity of about 0.8 to 1.0, a viscosity index (VI) of about 80 to 150, and a pour point of about −20° C. to 0°. In addition, the vacuum ionic refined oil may have a reduced impurity content compared to the original waste lubricant. The refined oil fraction shows a brown color of about 5 to 6 according to the ASTM standards. By the centrifugation and two-operation distillation, the vacuum ionic refined oil has a reduced content of sediment and moisture compared to the original waste lubricant.

In an embodiment, the vacuum ionic refined oil may have a sulfur content in a range of from 200 ppm to 3000 ppm, a nitrogen content in a range of 100 ppm and 1200 ppm, and a kinematic viscosity at 100° C. in a range of 4 to 11 cSt.

In an embodiment, the operation of providing the waste lubricant-derived refined oil fraction may include a solvent extraction or first hydrotreating operation. The solvent extraction of the waste lubricant-derived refined oil fraction is an operation of blending the refined oil fraction and a solvent in a blending tank, an operation of maintaining the mixture in a stationary state to reach phase separation, thereby obtaining a phase in which oil is a main component, and an operation of removing a phase containing a large amount of impurity. The solvent used for the solvent extraction is a solvent having a higher affinity to impurities than the oil component in the waste lubricant-derived refined oil fraction. As the solvent, N-methyl-2-pyrrolidone (NMP), sulfolane, DMSO, furfural, phenol, and acetone are commonly used. As the solvent, any solvent that has a high affinity to impurities and a low affinity to the waste lubricant-derived refined oil fraction so as to be phase-separated from the waste lubricant-derived refined oil fraction can be used. In addition, the solvent may exhibit a different volatility from the oil fraction in the subsequent solvent separation process.

The solvent extraction of the waste lubricant-derived refined oil fraction is carried out at a temperature of about 30° C. to 200° C., or about 30° C. to 150° C., or about 40° C. to 120° C., and at a pressure in a range of atmospheric pressure to 20 kg/cm$^2$, or in a range of atmospheric pressure to 15 kg/cm$^2$, or in a range of atmospheric pressure to 10 kg/cm$^2$.

In addition, the volume ratio of the solvent used in the solvent extraction operation of the waste lubricant-derived refined oil fraction with respect to the oil component in the refined oil fraction is 1:1 to 6:1, or 1:1 to 5:1, or 1:1 to 4:1, or 1:1 to 3:1, or 1:1 to 2:1, or 2:1 to 5:1, or 2:1 to 4:1, or 2:1 to 3:1, or 3:1 to 5:1, or 3:1 to 4:1, or 4:1 to 5:1. In an embodiment, the volume ratio may be in a range of from 1.5:1 to 3:1. The volume ratio in the mentioned range is advantageous in terms of the balance between the level of impurity removal through the solvent extraction and the yield of the lube base oil subsequently produced from the waste lubricant-derived refined oil fraction.

The first hydrotreating of the waste lubricant-derived refined oil fraction is an operation of hydrogenating the waste lubricant-derived refined oil fraction at high temperature and high pressure in the presence of a catalyst to remove sulfur, nitrogen, chlorine, and other metallic impurities contained in the waste lubricant-derived refined oil fraction, and is an operation of saturating the unsaturated hydrocarbons present in the waste lubricant-derived refined oil fraction.

The first hydrotreating may be performed in the presence of a catalyst. As the catalyst for the first hydrotreating, Ni—Mo-based catalysts, Co—Mo-based catalysts, Raney nickel, Raney cobalt, and platinum-based catalysts may be used, but the catalysts are not limited thereto. Any hydrogenation catalyst having an effect of promoting a hydrogen saturating reaction and an impurity removal reaction may be used without limitation.

The first hydrotreating is carried out in a temperature condition of 200° C. to 500° C., or about 250° C. to 450° C., or about 300° C. to 400° C., in a pressure condition of 50 kg/cm$^2$ to 300 kg/cm$^2$, or 50 kg/cm$^2$ to 250 kg/cm$^2$, or 100 kg/cm$^2$ to 200 kg/cm$^2$, in a liquid space velocity (LHSV) condition of 0.1 to 5.0 hr 1, or 0.3 to 4.0 hr$^{-1}$, or 0.5 to 3.0 hr$^{-1}$, at a volume ratio of hydrogen to refined oil in a range of 300 to 3000 Nm$^3$/m$^3$, or 500 to 2500 Nm$^3$/m$^3$, or 1000 to 2000 Nm$^3$/m$^3$. The above conditions are within a range in which the lifespan of a dewaxing catalyst is not affected, a removal level of impurity such as sulfur and nitrogen present in the waste lubricant-derived refined oil fraction is minimized, and the yield loss of an end product, which is a lube base oil, is minimized. The waste lubricant-derived refined oil fraction obtained by an oil fraction derived from waste lubricant to a refining process involving solvent extraction or first hydrotreating is referred to as "first regenerated base oil".

In an embodiment, the first regenerated base oil may have a sulfur content of 100 to 3000 ppm, a nitrogen content of 100 to 1000 ppm, and a chlorine content of 5 to 200 ppm. In addition, the first regenerated base oil may have a boiling point in a range of 350° C. and 550° C., or a range of 420° C. to 520° C. The boiling point range of the first regenerated base oil may be narrower than that of the ionic refined oil fraction.

The waste lubricant-derived refined oil fraction includes the aforementioned vacuum ionic refined oil, the first regenerated base oil, or a combination thereof.

In an embodiment, the vacuum ionic refined oil may have a sulfur content in a range of from 200 ppm to 3000 ppm, a nitrogen content in a range of 100 ppm and 1200 ppm, and a kinematic viscosity at 100° C. in a range of 4 to 11 cSt.

The method includes a dewaxing operation of dewaxing the waste lubricant-derived refined oil fraction to produce a second regenerated base oil. Herein, the term "second regenerated base oil" refers to a refined oil fraction derived from the waste lubricant that is dewaxed through the dewaxing operation. The dewaxing operation selectively isomerizes the wax component contained in the waste lubricant-derived refined oil fraction, thereby improving low-temperature characteristics (securing a low pour point) and maintaining a high viscosity index (VI). In an embodiment of the present disclosure, it is intended to achieve improvement in efficiency and yield through the improvement of the catalyst used in the dewaxing operation. The dewaxing operation may include a hydrotreating reaction, a hydro-dewaxing reaction, and a subsequent hydrofinishing reaction.

Prior to the hydro-dewaxing, a second hydrotreating may be performed to remove impurities remaining in the waste lubricant-derived refined oil fraction. The process conditions and catalyst for the second hydrotreating may be the same as those for the first hydrotreating.

In an embodiment, the hydro-dewaxing may be carried out in the presence of a catalyst including an EU-2 zeolite carrier and may be carried out at a temperature in a range of 300° C. to 350° C., and at a pressure in a range of 50 kg/cm$^2$ to 150 kg/cm$^2$. More specifically, the hydro-dewaxing may be carried out at a temperature in a range of 310° C. to 340° C., or a range of 320° C. to 330° C. and at a pressure in a range of 60 kg/cm$^2$ to 140 kg/cm$^2$, or a range of 60 kg/cm$^2$ to 130 kg/cm$^2$.

The subsequent hydrofinishing may be carried under the same conditions and catalyst used for the hydro-dewaxing operation, except that the process temperature is in a range of 200° C. to 250° C.

In general, the main reaction of catalytic dewaxing is designed to convert N-paraffin to iso-paraffin through an isomerization reaction to improve low-temperature properties. The catalyst used may be mainly a bi-functional catalyst. The bi-functional catalyst may be composed of two active components: a metal active component (metal site) for hydrogenation/dehydrogenation reaction and a carrier (acid site) for skeletal isomerization using carbynium ions. A catalyst having a zeolite structure is generally composed of an aluminosilicate carrier and at least one metal selected from Group 8 metals and Group 6 metals.

The dewaxing catalyst of the present disclosure may include a carrier having acidic sites, the carrier being selected from molecular sieves, alumina, and silica-alumina. The types of carriers having acid sites include molecular sieves, alumina, silica-alumina, and the like. Among these, the molecular sieves refer to crystalline aluminosilicates (zeolite), SAPO, ALPO, and the like. A medium pore molecular sieve with a 10-membered oxygen ring, such as SAPO-11, SAPO-41, ZSM-11, ZSM-22, ZSM-23, ZSM-35, and ZSM-48 is used, and a large pore molecular sieve with a 12-membered oxygen ring may be used.

In particular, in an embodiment of the present disclosure, EU-2 zeolite having a controlled phase transition degree may be used as the carrier. After pure zeolite is generated, the synthesis conditions are likely to change, or the synthesized zeolite crystal is likely to gradually transition to a more stable phase if the synthesis continues over a predetermined period time. This phenomenon is referred to as phase transformation of zeolite. It was confirmed that isomerization selection performance was improved according to the degree of phase transformation of the zeolite, and excellent performance was also exhibited in the catalytic dewaxing reaction using the same.

In an embodiment, the catalyst may include Co, Ni, Pt, Pd, Mo, W, or any combination thereof as a metal active component. The catalyst may include one or more hydrogenating metals selected from the elements of Groups 2, 6, 9 and 10 in the Periodic table. In particular, among the metals in Groups 9 and 10 (i.e., Group VIII metals), Co, Ni, Pt, and Pd may be used, and among the metals in Group 6 (i.e., Group VIB metals), Mo and W may be used.

The second regenerated base oil produced in the presence of the catalyst as described above may have a sulfur content of less than 5 ppm, a nitrogen content of less than 1 ppm, and a viscosity index in a range of 100 to 120, so that the second regenerated base oil may have a property close to that of a Group III lube base oil. In an embodiment, when the second regenerated base oil produced in the dewaxing operation has an impurity content higher than sulfur content and the nitrogen content, the second regenerated base oil may undergo additional hydrotreating for removal of the impurities after the dewaxing operation.

The method may include a blending operation of blending the second regenerated base oil with a separate lube base oil to produce a lube base oil mixture of Group III or higher. Herein, the Group III or higher lube base oil mixture refers to a lube base oil mixture having characteristics corresponding to group III of Table 1, or a lube base oil mixture having a lower sulfur content, higher saturation degree, and/or higher viscosity index than Group III lube base oils. As described above, the second regenerated base oil has characteristics close to those of Group III lube base oils. Therefore, when the second regenerated base oil is blended in a certain amount with a separate Group III or higher lube base oil, the lube base oil mixture as the end product is a Group III or higher lube base oil. The method can reduce the cost of manufacturing Group III or higher lube base oils by utilizing oil components derived from waste lubricant containing a Group I or II lube base oil as a feedstock for manufacturing group III or higher lube base oils.

In an embodiment, the separate lube base oil may have a kinematic viscosity (at 100° C.) of 6 to 7 cSt, a viscosity index of 120 or more, a pour point of −10° C. or less, and a cold crank simulator (CCS) viscosity (at −30° C.) of 5400 cP or less. In addition, the separate lube base oil may have a sulfur, nitrogen, and chlorine content of less than 1 ppm.

In an embodiment, the amount of the second regenerated base oil blended in the blending operation may be 1% to 30% by volume of the Group III or higher lube base oil mixture. When the amount of the second recycled base oil used in the blending operation is less than 1% by volume of the Group III or higher lube base oil mixture, the manufacturing cost savings may not be significant due to the low percentage of the second regenerated base oil in the Group III or higher lube base oil mixture, which is an end product. When the amount of the second regenerated base oil used in the blending operation is less than 1% by volume of the Group III or higher lube base oil mixture, the Group III or higher lube base oil mixture, which is an end product, may not have the characteristics of Group III or higher lube base oils. In an embodiment, the amount of the second regenerated base oil blended in the blending operation may be 5% to 25% by volume of the Group III or higher lube base oil mixture or 10% to 20% by volume of the Group III or higher lube base oil mixture.

Figure 2:
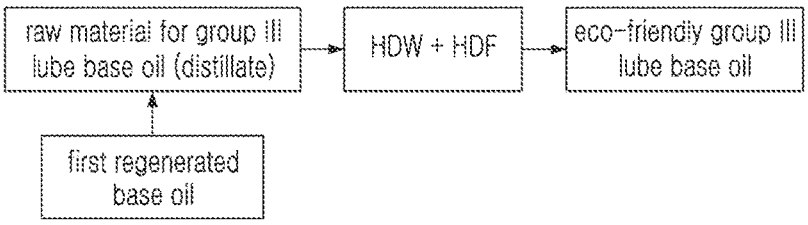

According to a second embodiment of the present disclosure, there is provided a method of producing a lubricating base oil mixture, the method including the operation of blending the first regenerated base oil with the separate lube base oil and the subsequent hydro-dewaxing and hydrofinishing. The method may be performed as schematically illustrated in FIG. 2. The first regenerated base oil 30 and the separate lube base oil 80 used in the method may have the same properties as the first regenerated base oil and the separate lube base oil according to the first embodiment of the present disclosure, and the blending amount and the process conditions of the hydro-dewaxing ("HDW") and hydrofinishing ("HDF") operations (indicated with numeral 100 in FIG. 2) may also be the same as the ones employed according to the first embodiment of the present disclosure. According to the method above, a lube base oil mixture of group III or higher may be obtained.

According to a third embodiment of the present disclosure, there is provided a lube base oil mixture including the second regenerated base oil. As described above, the second regenerated base oil corresponds to a dewaxed refined oil component derived from waste lubricant containing a Group I or II lube base oil, and the lube base oil mixture containing the second regenerated base oil can maintain the characteristics of Group III lube base oils while containing an oil component derived from waste lubricant. The lube base oil mixture containing the second regenerated base oil according to one embodiment of the present disclosure is economically beneficial in that oil derived from a lower grade lube base oil can be utilized as a component of a higher grade lube base oil, and environmentally beneficial in that the amount of waste lubricant that is disposed of can be reduced by recycling the waste lubricant as a feedstock for a higher grade lube base oil manufacturing process.

In an embodiment, the lube base oil mixture containing the second regenerated base oil may have a viscosity index of greater than 120 and a saturation degree of 90% or higher. The lube base oil mixture containing the second regenerated base oil may be a lube base oil that meets the viscosity index and saturation degree of Group III lube base oils shown in Table 1. In an embodiment, the lube base oil mixture containing the second regenerated base oil may have a viscosity index of 125 or more, or a viscosity index of 130 or more. In addition, the lube base oil mixture containing the second regenerated base oil may have a saturation degree of 95% or more, or a saturation degree of 99% or more.

In an embodiment, the lube base oil mixture containing the second regenerated base oil may have a sulfur content of less than 1 ppm, a nitrogen content of less than 1 ppm, and a chlorine content of less than 1 ppm. The lube base oil mixture containing the second regenerated base oil may not only fulfill the impurity content condition of Group III lube base oils, but may also be substantially free of impurities.

In an embodiment, the lube base oil mixture containing the second regenerated base oil may have a Saybolt color value of 27 or higher. When a lube base oil has a Saybolt color value of 27 or greater, the lube base oil is considered a lube base oil having stability corresponding to Water White grade. Water White grade lube base oil has a sulfur and nitrogen content of less than 1 ppm, a saturation degree of 99% or more, and an aromatic content of less than 1%. This lube base oil is more stable than a conventional API Group III lube base oil.

In an embodiment, the lubricant base oil mixture containing the second regenerated base oil may exhibit a UV 260-350 nm absorbance of 2.5 or less and a UV 325 nm absorbance of 0.7 or less, as measured by ASTM D 2008. Here, the absorbance at a wavelength of 260 to 350 nm indicates that the test material contains a component having 3 or more aromatic rings, and the absorbance at a wavelength of 325 nm indicates that the test material contains a component having 3 to 7 aromatic rings. The lube base oil mixture containing the second regenerated base oil exhibits a low absorbance at these wavelengths. That is, the lube base oil mixture has a low aromatic content, thereby exhibiting high stability.

Hereinafter, the preferred examples are presented to aid understanding of the embodiments of the present disclosure. However, the following examples are provided only to facilitate easier understanding of the embodiments of the present disclosure, and the embodiments are not limited thereto.

Examples

Measurement of behavior and characteristics of lube base oils produced by production method of present disclosure.

A waste lubricant having a sulfur content of about 2000 ppm, a nitrogen content of about 1500 ppm, and a chlorine content of about 1500 ppm was centrifuged at a speed of about 300 rpm, followed by atmospheric distillation and vacuum distillation, to obtain a vacuum ionic refined oil. The vacuum ionic refined oil obtained through vacuum distillation performed under the process conditions described below contained a heavy oil fraction with a boiling point of 400° C. or more and 550° C. or less.

Here, the atmospheric distillation was performed at a temperature of 50° C. to 350° C. at atmospheric pressure. The process conditions of the vacuum distillation are shown in Table 2 below.

TABLE 2

| Process conditions of vacuum distillation | |
|---|---|
| Temperature | 100° C. to 350° C. |
| Pressure | 10 torr |

In addition, separate waste lubricant having the same impurity content as the waste lubricant described above is hydrotreated in a temperature condition of about 300° C., a pressure condition of about 60 to 150 kg/cm$^2$, a liquid hourly space velocity (LHSV) condition of about 3.0 hr$^{-1}$, and a volume ratio of hydrogen to oil derived from the waste lubricant of about 1000 to obtain a first regenerated base oil. Subsequently, the vacuum ionic refined oil and the first regenerated base oil were mixed in a volume ratio of 1:1 to obtain a waste lubricant-derived refined oil fraction, followed by hydro-dewaxing of the waste lubricant-derived refined oil fraction. The hydro-dewaxing is performed at a temperature of about 350° C. and a pressure of about 150 kg/cm$^2$, in the presence of a hydrogenation catalyst containing EU-2 zeolite as a carrier and Ni as a metal active component. The subsequent hydrofinishing is carried out in the presence of the same hydrogenation catalyst as used in the hydro-dewaxing, at a temperature of about 230° C. and at a pressure of about 60 to 150 kg/cm$^2$. After the hydro-dewaxing and hydrofinishing, a second regenerated base oil was obtained.

The obtained second regenerated base oil was blended with a separate lube base oil YU-6 having a kinematic viscosity at 100° C. of 6.3 cSt, a viscosity index of 130, a pour point of −12° C., and a CCP viscosity at −30° C. of 6200 cP, to obtain a lube base oil mixture. Here, the amount of the second regenerated base oil used in the blending was 20% by volume of the lube base oil mixture.

The lube base oil mixture prepared by the above production method was measured for various properties, and as a result of the measurements, the lube base oil had a specific gravity of 0.84, a kinematic viscosity at 100° C. of 7.3 cSt, a viscosity index (VI) of 129, and a kinematic viscosity at −33° C. of 120, a sulfur content of less than 1 ppm, a nitrogen content of less than 1 ppm, and contained almost no impurities except for unavoidable trace amounts of impurities. In addition to the properties described above, other properties of the lube base oil mixture are shown in Table 3 below.

TABLE 3

Characteristics of lube base oils produced by the method of the present disclosure:

| Classification | Test method | Specification |
|---|---|---|
| Appearance | Visual | Bright & Clear |
| Saybolt Color | ASTM D 156 | Min. +27 |
| Saturation % | ASTM D 7419 | Min. 99 |
| UV 260 to 250 nm | ASTM D 2008 | Max. 3.0 |
| UV 325 nm | ASTM D 2008 | Max. 1.0 |
| Viscosity index | ASTM D 2270 | Min. 120 |

It was found that the lube base oil mixture had a viscosity index of at least 120 and a saturation degree of at least 95%, thus fulfilling the criteria of Group III lube base oils shown in Table 1 above. The lube base oil mixture was bright and clear in color when visually evaluated and exhibited a Saybolt color value of 27 or greater as measured in accordance with ASTM D 156. That is, the lube base oil is a lube base oil having a water white grade, and the lube base oil has high thermal stability at high temperatures.

In addition, the lube base oil mixture exhibits a low absorbance of up to 3.0 (up to 1.0 at a wavelength of 325 nm) when measured according to ASTM D 2008 for UV having a wavelength of 260 to 350 nm, and especially for UV having a wavelength of 325 nm. It was confirmed that the lube base oil mixture had high stability against UV.

As described above, using a certain amount of waste lubricant-derived regenerated base oil as a feedstock for the production of a lube base oil can increase the stability and yield of the final product lube base oil and has environmental benefits in that the waste lubricant is reused as a feedstock for lube base oil production rather than being simply disposed of.

Herein above, the embodiments of the present disclosure have been described in detail with reference to specific embodiments. Embodiments are intended to illustrate the scope of the present disclosure in detail, and the embodiments of the present disclosure are not limited thereto. It will be apparent to those skilled in the art that modifications thereto or improvements thereof are possible within the technical spirit of the present disclosure.

All simple modifications and alterations of the embodiments of the present disclosure fall within the scope of the present disclosure and the following claims. Furthermore, the embodiments may be combined to form additional embodiments.

What is claimed is:

1. A method of producing a lube base oil mixture, the method comprising:

providing a waste lubricant-derived refined oil fraction derived from a waste lubricant comprising a lube base oil of API Group I or II, wherein the waste lubricant-derived refined oil fraction comprises a vacuum ionic refined oil;

dewaxing the waste lubricant-derived refined oil fraction to produce a second regenerated base oil; and blending the second regenerated base oil with a separate lube base oil to produce a lube base oil mixture of Group III or higher.

2. The method of claim 1, wherein the waste lubricant-derived refined oil fraction has a sulfur content in a range of 200 ppm to 3000 ppm, a nitrogen content in a range of 100 ppm and 1200 ppm, and a kinematic viscosity at 100° C. in a range of 4 to 11 cSt.

3. The method of claim 1, wherein the dewaxing comprises hydrotreating hydro-dewaxing, and hydrofinishing the waste lubricant-derived refined oil fraction.

4. The method of claim 3, wherein the hydro-dewaxing is carried out in the presence of a catalyst comprising at least one of an EU-2 zeolite carrier, an alumina carrier, and a silica-alumina carrier, and is carried out at a temperature in a range of 300° C. to 350° C. and at a pressure in a range of 60 kg/cm$^2$ to 150 kg/cm$^2$.

5. The method of claim 4, wherein the catalyst comprises Co, Ni, Pt, Pd, Mo, W, or any combination thereof as a metal active component.

6. The method of claim 1, wherein an amount of the second regenerated base oil blended during the blending is 1% to 30% by volume of the lube base oil mixture of Group III or higher.

7. A lube base oil mixture comprising the second regenerated base oil of claim 1.

8. The lube base oil mixture of claim 7, wherein the lube base oil mixture comprising the second regenerated base oil has a viscosity index of 120 or more and a saturation degree of 90% or more.

9. A method of producing a lube base oil mixture, the method comprising:

providing a waste lubricant-derived refined oil fraction derived from a waste lubricant comprising a lube base oil of API Group I or II, wherein the waste lubricant-derived refined oil fraction comprises a vacuum ionic refined oil, a first regenerated base oil, or a combination thereof;

dewaxing the waste lubricant-derived refined oil fraction to produce a second regenerated base oil; and blending the second regenerated base oil with a separate lube base oil to produce a lube base oil mixture of Group III or higher, wherein the separate lube base oil has a kinematic viscosity at 100° C. of 6 to 7 cSt, a viscosity index of 120 or more, a pour point of −10° C. or less, and a cold crank simulator (CCS) viscosity at −30° C. of 5400 cP or less.

10. A method of producing a lube base oil mixture, the method comprising:

subjecting an ionic refined oil to a vacuum distillation to obtain a vacuum ionic refined oil;

mixing the vacuum ionic refined oil with a first regenerated base oil to make a waste lubricant-derived refined oil fraction;

dewaxing the waste lubricant-derived refined oil fraction to produce a second regenerated base oil; and blending the second regenerated base oil with a separate lube base oil to produce a lube base oil mixture of Group III or higher.

11. The method of claim 10, wherein the vacuum refined oil contained a heavy oil with a boiling point of 400° C. or more and 550° C. or less.

12. The method of claim 10, wherein prior to the vacuum distillation the ionic refined oil is produced by subjecting a first waste lubricant having a sulfur content of about 2000 ppm, a nitrogen content of about 1500 ppm, and a chlorine content of about 1500 ppm to centrifugation followed by atmospheric distillation.

13. The method of claim 12, wherein the atmospheric distillation was performed at a temperature of 50° C. to 350° C. at atmospheric pressure, and wherein the vacuum distillation was performed at a temperature of 100° C. to 350° C. and a pressure of 10 torr.

14. The method of claim 12, wherein the first regenerated base oil is produced by subjecting a second waste lubricant having a same impurity content as the first waste lubricant described above to hydrotreating in a temperature condition of about 300° C., a pressure condition of about 60 to 150 $kg/cm^2$, a liquid hourly space velocity (LHSV) condition of about 3.0 $hr^{-1}$, and a volume ratio of hydrogen to oil derived from the waste lubricant of about 1000.

15. The method of claim 12, wherein the vacuum ionic refined oil and the first regenerated base oil were mixed in a volume ratio of 1:1.

16. The method of claim 10, wherein the hydro-dewaxing is performed at a temperature of about 350° C. and a pressure of about 150 $kg/cm^2$, in the presence of a hydrogenation catalyst containing EU-2 zeolite as a carrier and Ni as a metal active component, wherein the hydrofinishing is carried out in the presence of the same hydrogenation catalyst as used in the hydro-dewaxing, at a temperature of about 230° C. and at a pressure of about 60 to 150 $kg/cm^2$.

* * * * *